US006789629B1

(12) United States Patent
Jones

(10) Patent No.: US 6,789,629 B1
(45) Date of Patent: Sep. 14, 2004

(54) BUBBA DRAG IMPROVEMENTS

(75) Inventor: Leland W. Jones, St. Cloud, FL (US)

(73) Assignee: Leland Jones, St. Cloud, FL (US)

( * ) Notice: Subject to any disclaimer, the term of this patent is extended or adjusted under 35 U.S.C. 154(b) by 0 days.

(21) Appl. No.: 10/447,528

(22) Filed: May 29, 2003

Related U.S. Application Data

(63) Continuation-in-part of application No. 10/208,365, filed on Jul. 30, 2002, now abandoned.

(51) Int. Cl.[7] ..... E02F 3/815

(52) U.S. Cl. ..... 172/708; 172/701.1; 172/799.5; 172/684.5

(58) Field of Search ..... 172/701.1, 799.5, 172/684.5, 705, 708, 736, 734, 744; 37/268, 271

(56) References Cited

U.S. PATENT DOCUMENTS

| | | | | | |
|---|---|---|---|---|---|
| 1,373,799 | A | | 4/1921 | Conley | |
| 2,014,479 | A | | 9/1935 | Martin | 37/169 |
| 3,757,871 | A | * | 9/1973 | Maust et al. | 172/178 |
| 3,777,823 | A | | 12/1973 | Holfeld | 172/328 |
| 3,795,069 | A | | 3/1974 | Cheney | 37/48 |
| 3,917,004 | A | * | 11/1975 | Finley | 172/328 |
| 4,245,458 | A | | 1/1981 | Smith | 56/376 |
| 4,386,662 | A | * | 6/1983 | Kalif | 172/445.1 |
| 4,403,432 | A | * | 9/1983 | Biance | 37/235 |
| 4,630,686 | A | | 12/1986 | Ausmus, Jr. | 172/393 |
| 5,136,795 | A | * | 8/1992 | Rosenberg | 37/233 |
| 5,407,015 | A | * | 4/1995 | Swords et al. | 172/200 |
| 5,485,690 | A | * | 1/1996 | MacQueen | 37/271 |
| 5,595,007 | A | * | 1/1997 | Biance | 37/268 |
| 5,669,452 | A | * | 9/1997 | Wright et al. | 172/685 |
| 6,021,853 | A | | 2/2000 | Atkins | 172/780 |
| 6,112,828 | A | | 9/2000 | Leal | 172/684.5 |
| 6,202,328 | B1 | * | 3/2001 | Fulton | 37/231 |
| 2001/0023546 | A1 | * | 9/2001 | Fulton | 37/231 |
| 2002/0043009 | A1 | * | 4/2002 | Fulton, III | 37/266 |
| 2003/0178209 | A1 | * | 9/2003 | Knobloch et al. | 172/145 |

* cited by examiner

*Primary Examiner*—Robert E. Pezzuto
*Assistant Examiner*—Alexandra K. Pechhold
(74) *Attorney, Agent, or Firm*—Brian S. Steinberger; Law Offices of Brian S. Steinberger, P.A.

(57) ABSTRACT

A mobile trailer having an easily raisable and lowerable ground engaging scraper/leveler planar type plate that a single user can raise and lower by a lever arm. Various spring type members allow for the plate to be easily moved upward and downward, and the plate can be locked in a raised position. The trailer can be easily towed behind small tractors and all terrain vehicles(ATVs). Another embodiment allows the plate to be easily raised and lowered by a single arm having one end pivotally attached t a support frame on the mobile trailer. The arm can be slid into side catches so that the plate is at selected heights as needed. Another embodiment allows for a barrel to be pivotally attached to the frame so that raising and lowering the arm allows for a filled barrel to be turned upside down discharging any contents in the barrel.

14 Claims, 11 Drawing Sheets

Fig.11A
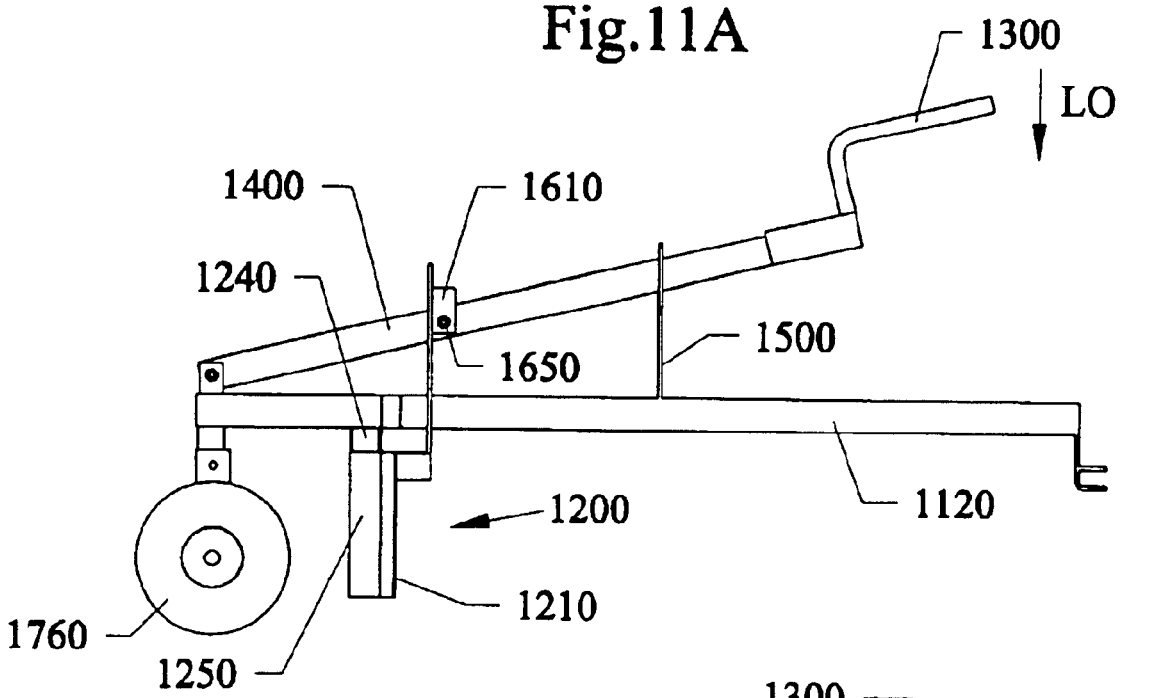
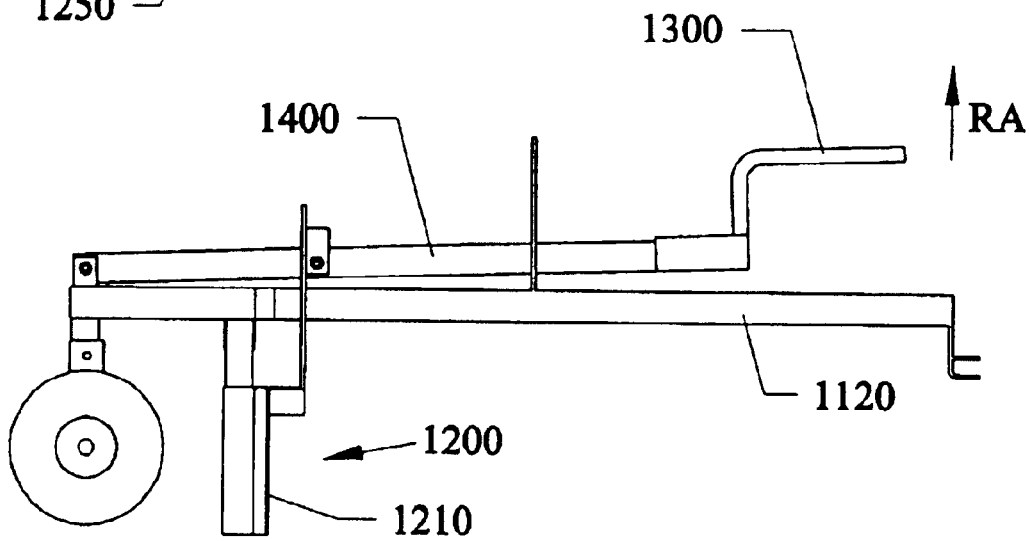
Fig.11B

BUBBA DRAG IMPROVEMENTS

This invention is a Continuation-In-Part of U.S. patent application Ser. No. 10/208,365 filed Jul. 30, 2002, now abandoned and relates to trailers with ground dragging members, in particular to trailers having easily raisable and lowerable scraper bars which can scrape and/or level the ground as the trailers are being towed behind vehicles such as a riding mower and ATV(all terrain vehicle).

BACKGROUND AND PRIOR ART

For various applications the need has always existed for leveling and scraping ground surfaces. For example, when building a home fill dirt has been used to fill in uneven ground surfaces where soil is deposited and the new soil must be leveled so that a level foundation can be constructed. Additionally, farms and ranches have a continuous need for leveling ground surfaces for their businesses when planting and performing daily activities. Furthermore, individual home owners have sometimes had a need for leveling uneven ground surfaces when planting a garden, and the like.

Various types of leveling devices have been proposed over the years. See for example, U.S. Pat. No. 1,373,799 to Conley; U.S. Pat. No. 2,014,479 to Martin; U.S. Pat. No. 3,777,823 to Holfeld; U.S. Pat. No. 3,795,069 to Cheney; U.S. Pat. No. 4,245,458 to Smith; U.S. Pat. No. 4,630,686 to Ausmus; U.S. Pat. No. 6,021,853 to Atkins; and U.S. Pat. No. 6,112,828 to Leal. However, these prior art devices have problems which extensively limit their use.

For example, most of these devices are large and cumbersome and require tractors to tow or push the devices. Also, these prior art devices generally require large spaces to be stored, and these devices are not able to be easily maneuverable and cannot work on small projects. Additionally, many of these devices can be expensive to purchase, and also would be expensive and difficult to operate and would not be easily useable by a single worker. These devices often require the user have to physically raise and lower extremely heavy ground engaging members. Many of the devices have curved shovels that must be carefully angled and are difficult to orient. Furthermore, some of the prior art devices are not easily transportable over all ground surface terrains since they use sleds. Thus, the need exists for solutions to the above problems with the prior art.

SUMMARY OF THE INVENTION

The first objective of the present invention is to provide devices and methods for leveling and scraping soil that can be towed behind any vehicle from small tractors, all terrain vehicles(ATVs) and large vehicles.

The second objective of the present invention is to provide devices and methods for leveling and scraping soil with a scraper/leveler bar that can be easily raised and lowered by a single person.

The third objective of the present invention is to provide devices and methods for leveling and scraping soil that are easily maneuverable and can work on both large and small projects.

The fourth objective of this invention is to provide devices and methods for leveling and scraping soil that are compact with minimal parts and can be inexpensively maintained and operated.

A first preferred embodiment of the invention can include a frame with at least one wheel thereon, a planar plate attached to the frame, the plate being moveable from a lowered position substantially perpendicular to and adjacent to a ground surface and an upper position substantially perpendicular to and raised above the ground surface, and a hand actuated lever pivotally attached to the frame for moving the planar plate from the lowered position to the raised position. The invention can also include first and second biasing members, such as springs, for biasing the planar plate in raised and lowered positions.

A pivotal arm can also be included having one end being moved up and down by the lever, and a second end connected to an end of the second biasing member which is attached to the frame. A rotatable member such as a wheel can be used for allowing a portion of the lever to ride along a portion of the arm, and a catch can be used for locking the arm in one position with the plate in the upper position. The invention can include a hitch portion for attaching the frame to a mobile vehicle.

A second embodiment of the invention can use a single arm having one end pivotally attached to the frame and a handle raising opposite end. A triangular frame attached to a midportion of the arm can raise and lower the leveling plate to and above the ground surface. A latch mechanism attached to the frame can include side slots so that the user can slide the handle in horizontal directions when vertically raising and lowering the arm to lock the arm at various heights to the frame. Telescopic members function to strengthen the vertical orientation and allow the leveling plate to be fixably held in vertical perpendicular orientation while the invention is being moved over a ground surface. Telescopic legs attached to wheels allow the frame to be locked to different heights above the ground surface.

An additional embodiment can be interchanging an open topped barrel onto the towable frame. The barrel can be pivotally attached to the frame with a rearwardly facing handle/lever so that pushing down on the lever causes the barrel to rotate about the pivot point to become upside down emptying out the contents of the barrel.

Further objects and advantages of this invention will be apparent from the following detailed description of the presently preferred embodiments which are illustrated schematically in the accompanying drawings.

BRIEF DESCRIPTION OF THE FIGURES

FIG. 11A is a right side view of the second embodiment with the dragging/leveling plate in a raised position.

FIG. 11B is a side view of the second embodiment with the dragging/leveling plate in a ground engaging lowered position.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

First Embodiment

Figure 1:
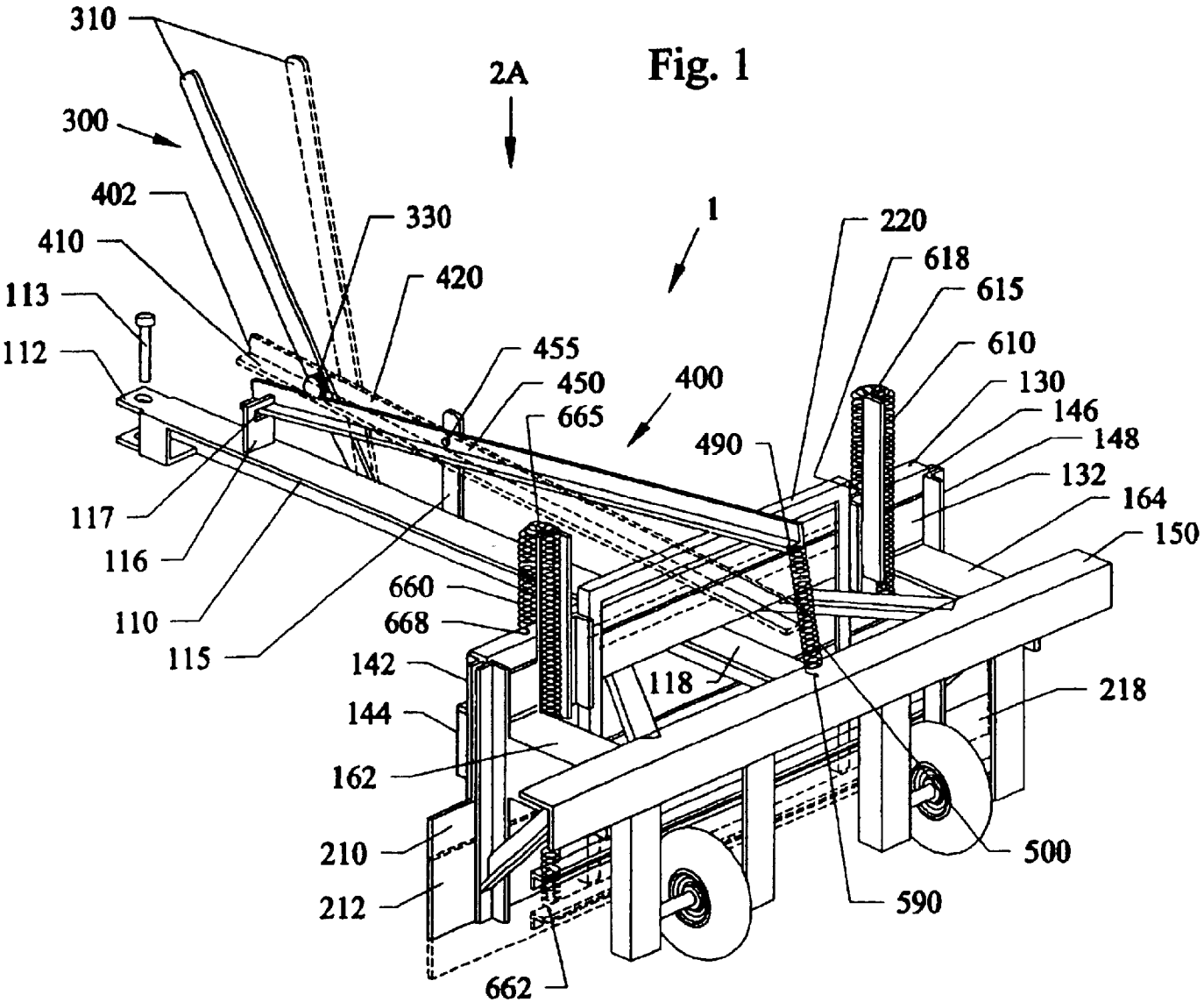
FIG. 1 is a perspective view of a first preferred embodiment of the invention.
Figure 2A:
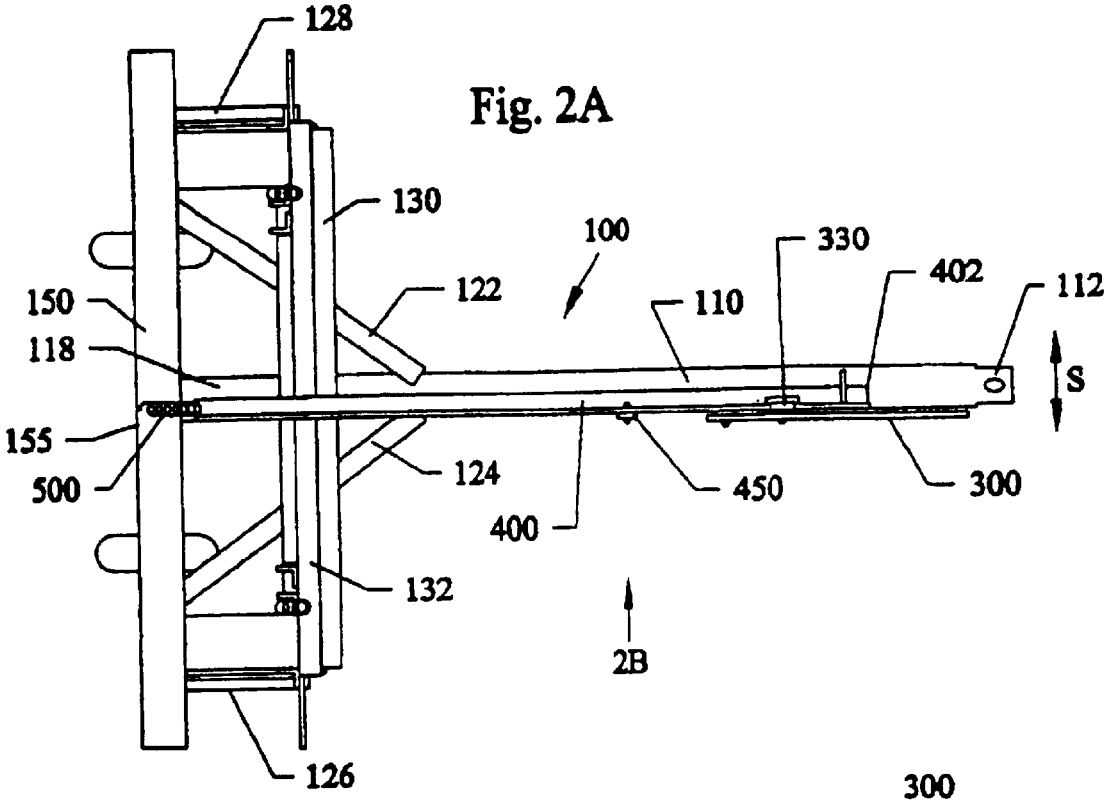
FIG. 2A is a top view of the embodiment of FIG. 1 along arrow 2A.
Figure 2B:
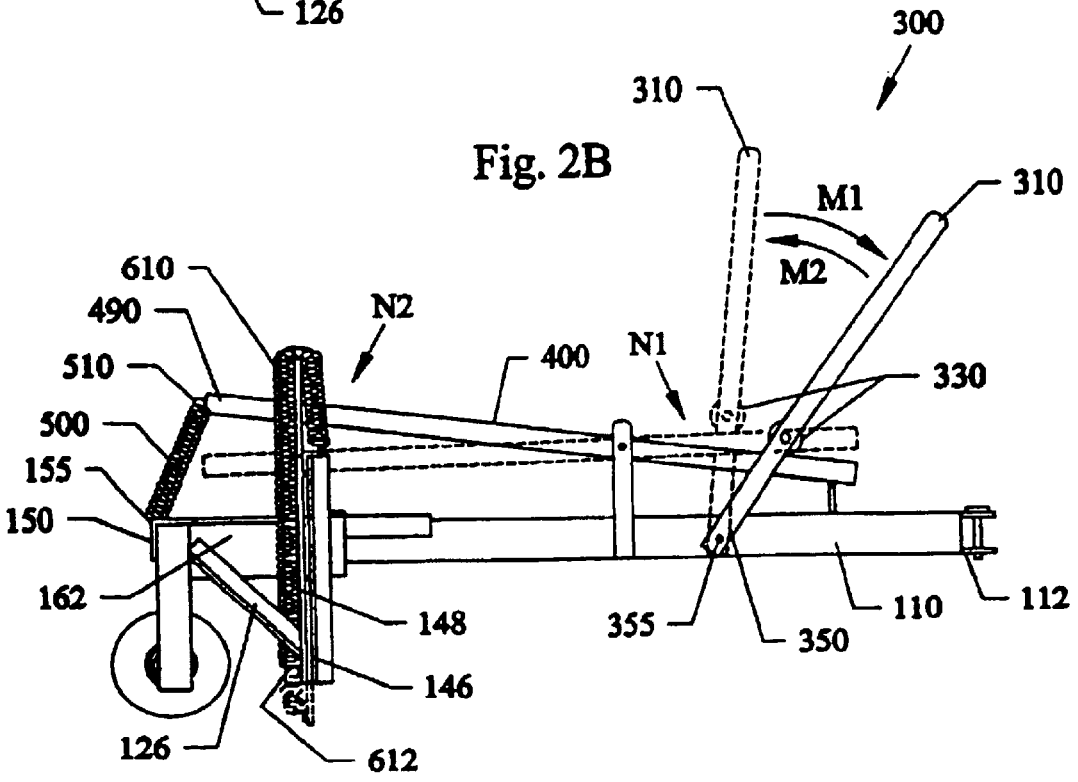
FIG. 2B is a side view of the embodiment of FIG. 2A along arrow 2B.
Figure 3:
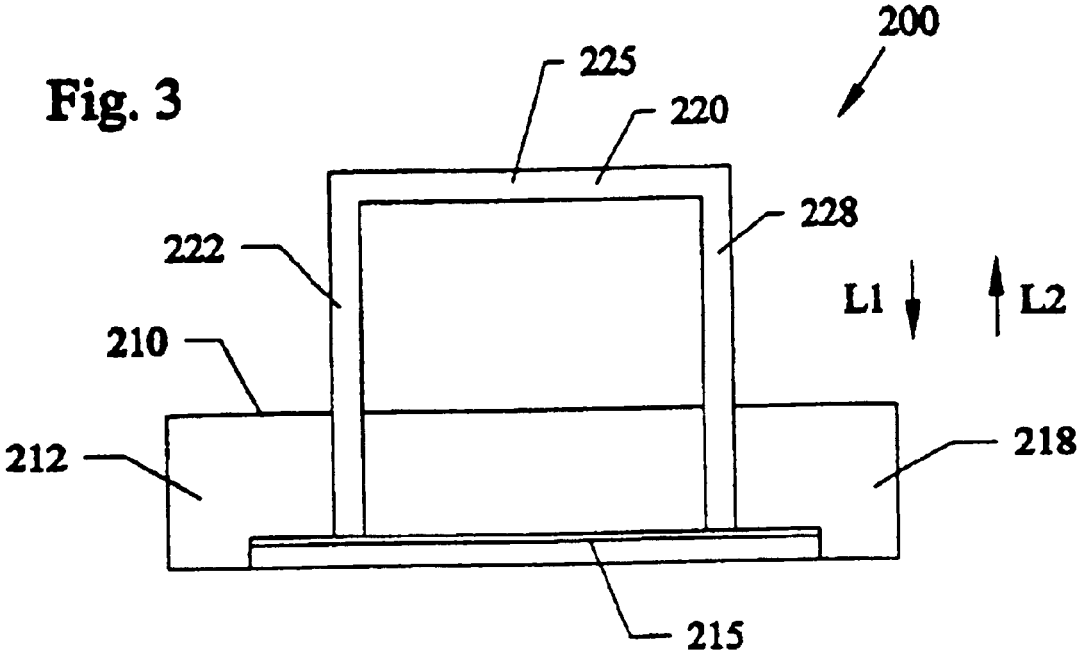
FIG. 3 is an exploded front view of the leveling plate and lift bracket and rear support frame of the embodiment of FIGS. 1, 2A–2B.
Figure 3:
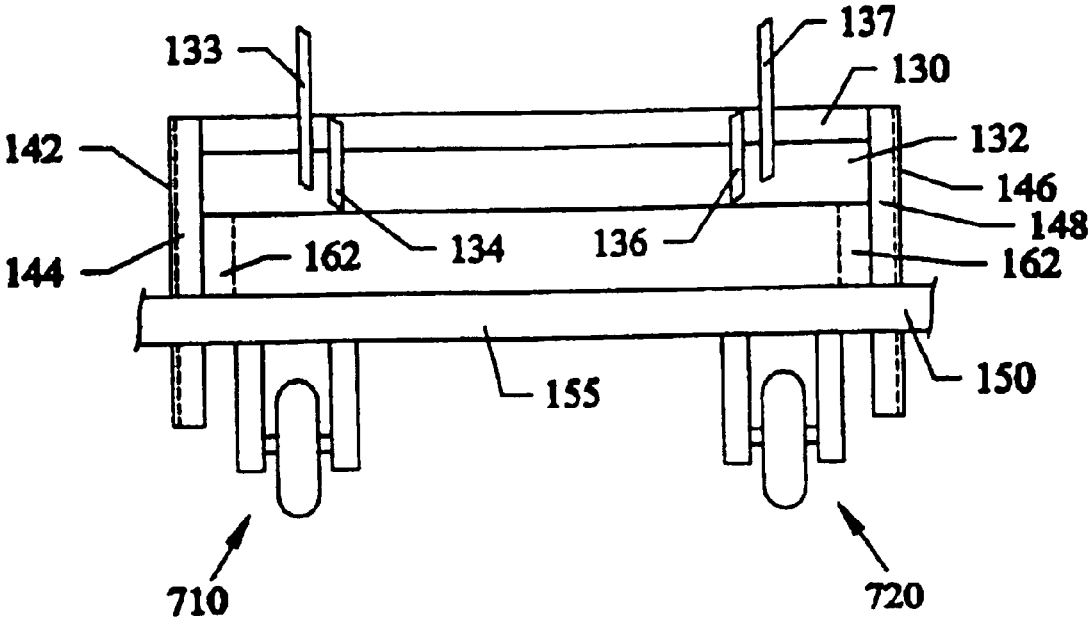

FIG. 1 is a perspective view of a preferred embodiment of the trailer invention 1. FIG. 2A is a top view of the trailer embodiment 1 of FIG. 1 along arrow 2A. FIG. 2B is a side view of the embodiment 1 of FIG. 2A along arrow 2B. FIG. 3 is an exploded front view of the leveler/scraper 200 and rear support frame for the trailer embodiment 1 of FIGS. 1, 2A–2B. The leveler/scraper 200 includes a substantially planar shaped leveling plate 210 and lift bracket 220 which will now be described.

Referring to FIGS. 1, 2A, 2B and 3, the novel trailer 1 includes a T-shaped frame 100 having a longitudinal member 110, and two parallel rear horizontal members 130, 150. Longitudinal frame member 110 includes a hitch portion 112 having a through-hole for receiving a hitch pin 113, and a rear end portion 118 attached to the rear frame support members 130, 150 by angled strut type members 122, 124, 126, 128.

The rear frame upper horizontal support member 130 is connected to side horizontal rear frame members 162, 164 by vertical pairs of L-shaped slide way members 142, 144 and 146, 148. Each of the pairs 142, 144 and 146, 148 of the vertical L-shaped slide way members having a space therebetween for allowing ends 212, 218 of the leveling plate 210 to slide therethrough when moving up and down in the direction of arrows L1 and L2. Horizontal rear frame members 162, 164 also fixably connect lower rear horizontal frame member 160 to Vertical pairs 142, 144 and 146, 148.

Vertical support flanges 134 and 136 are fixably mounted on front wall portion 132 of horizontal member 130 abut about and allow the outer edges of vertical legs 222 and 228 of the lift bracket 220 to slide up and down therebetween also in the direction of double arrows L1 and L2.

Dual wheels 710, 720 can be positioned off the frame member 155 for allowing the invention to be easily mobile and versatile.

Referring to FIGS. 1, 2A and 2B trailer embodiment 1 can include a hand actuated lever 300 can include an upper end portion 310 that can be moved back and forth in the direction of arrows M1 and M2 having a lower end portion 350 that can be pivotally attached to a side portion of longitudinal frame member 10 by a pivot pin 355. Along an inner surface of the lever 300 midway along the length of lever 300 can be a rotatable member such as a wheel 330 which can rotate along an upper edge of a pivotal horizontal arm 400. The Horizontal arm 400 can have a substantially L-shaped configuration with a horizontal elongated leg portion 410 perpendicular to a vertical elongated leg portion 420. Horizontal arm 400 can include a mid portion 450 that is pivotally attached by a pin type member 455 to a vertically raised support 115 that is attached to longitudinal frame member 110 so that horizontal arm 400 can move up and down in the direction of arrows N1 and N2. The wheel 330 attached to lever 300 can rotate along the horizontal leg portion 410 adjacent to end 402 of the arm 400. End portion 402 of pivotal arm is flexible enough so that it can be moved sideways in the direction of double arrow S so that horizontal leg portion 410 of arm 400 can catch into a side slot 117 in a raised support 116 that is attached to longitudinal frame member 110. Sliding the leg portion 410 of arm 400 into the slot 117 will allow the planar leveling/scraping plate 210 to be in a raised position.

Referring to FIGS. 1, 2A and 2B, a first biasing member 500 such as a spring has an upper end 510 attached to an end portion 490 of pivotal arm 400, and a lower end 590 attached to a midportion 155 of rear horizontal frame member 150. The spring member 500 biases the arm 400 in the direction of arrow N2 which pushes the leveling plate 210 in the ground engaging direction of arrow L2. The invention can also have second opposing biasing members. In this application a pair of biasing members 610 and 660, such as springs which constantly bias the leveling plate 210 upward in the direction of arrow L1. Each of the second biasing members 610, 660 can have ends 612, 662, respectively attached to an L-bracket 215 that is fixably attached across a front portion of the leveling plate 210, and opposite ends 618, 668 attached to an upper top edge of horizontal frame member 130 where each of the spring members 610, 660 having respective mid portions 615, 665 that overly and wrap over the raised top edges of vertical supports 133, 137, the latter of which are attached to portions of the front wall 132 of the horizontal frame member 130.

Figure 4:
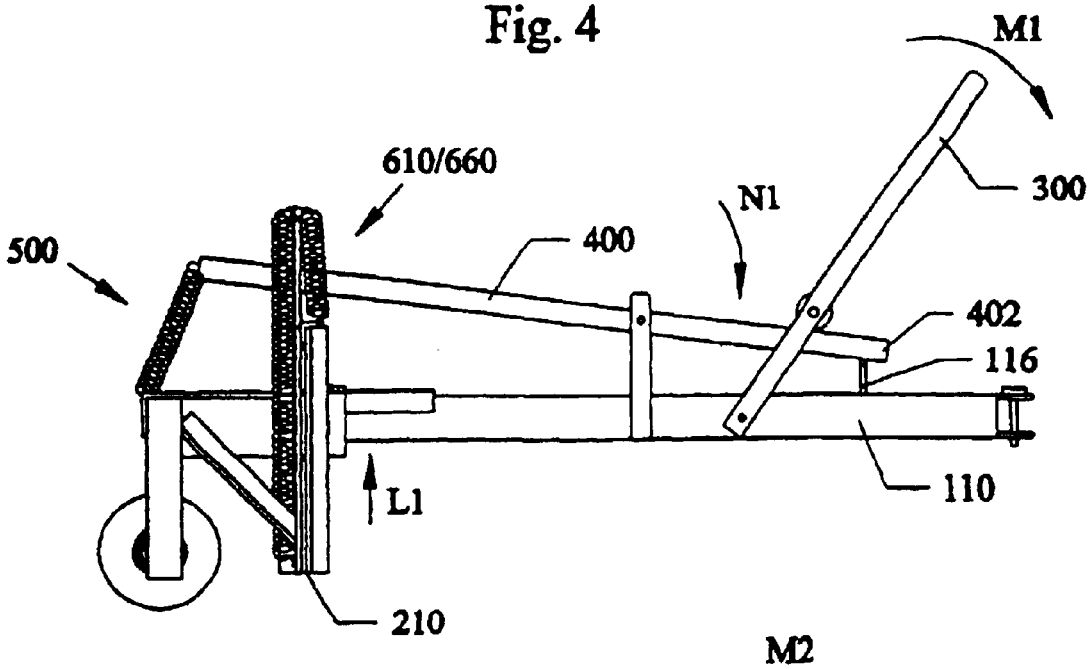
FIG. 4 is another side view of the embodiment of FIG. 1 with the dragging/leveling plate in a raised position.

FIG. 4 is another side view of the trailer embodiment 1 of preceding figures with the dragging/leveling plate 210 in a raised and locked position. Here lever 300 has been moved in the direction of arrow M1, moving arm end 402 downward in the direction of arrow N1 allowing the arm to be locked to the support 116 on the frame member 110, where the spring members 610, 660 are in a compressed positions, and spring member 500 is in an expanded position, and leveling plate 210 is in the raised position as indicated by the arrow L1.

Figure 5:
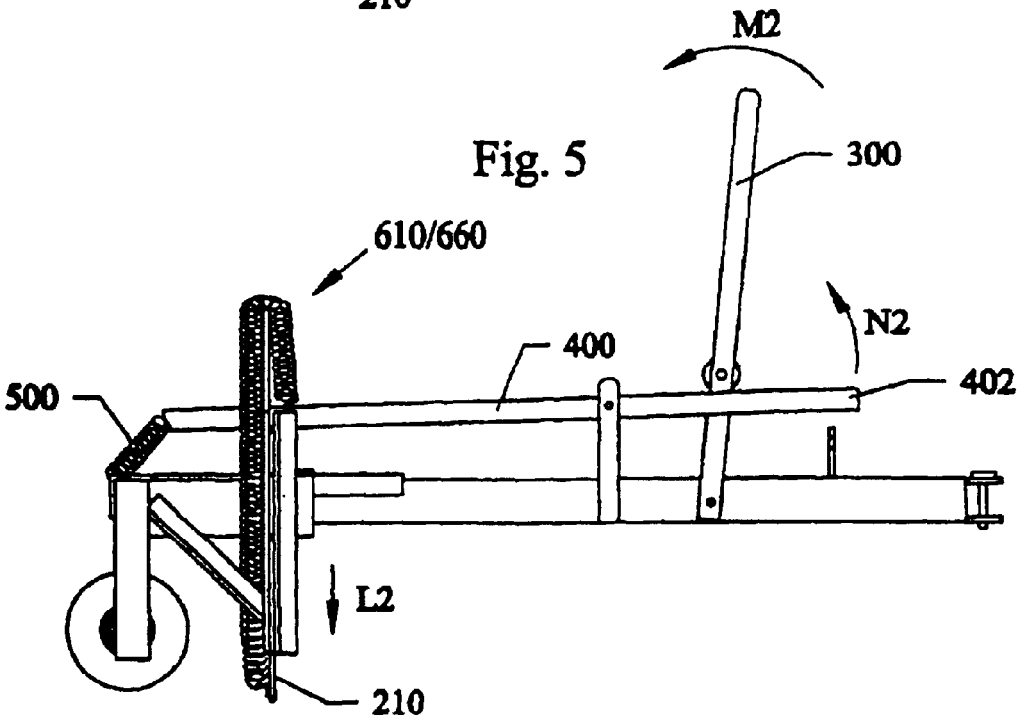
FIG. 5 is another side view of the embodiment of FIG. 1 with the dragging/leveling plate in a ground engaging lowered position.

FIG. 5 is another side view of the trailer embodiment 1 of the preceding figures with the dragging/leveling plate 210 in a ground engaging lowered position. Here lever 300 has been moved in the direction of arrow M2, allowing arm end 402 to pivot upward in the direction of arrow N2, so that arm portion 470 presses down on a midportion 225 of lift bracket 220(FIGS. 1, 3) pushing the leveling plate 210 downward in the direction of arrow L2 for ground engagement. Here spring member 500 can be compressed and biased and spring members 610, 660 can be in stretched positions. Clearly, the invention can contemplate having a spring member 500 that has a higher biasing pressure than that of both spring members 610, 660 so that the leveling plate 210 would generally remain in the downward position pushing in the direction of arrow L2.

Figure 6:
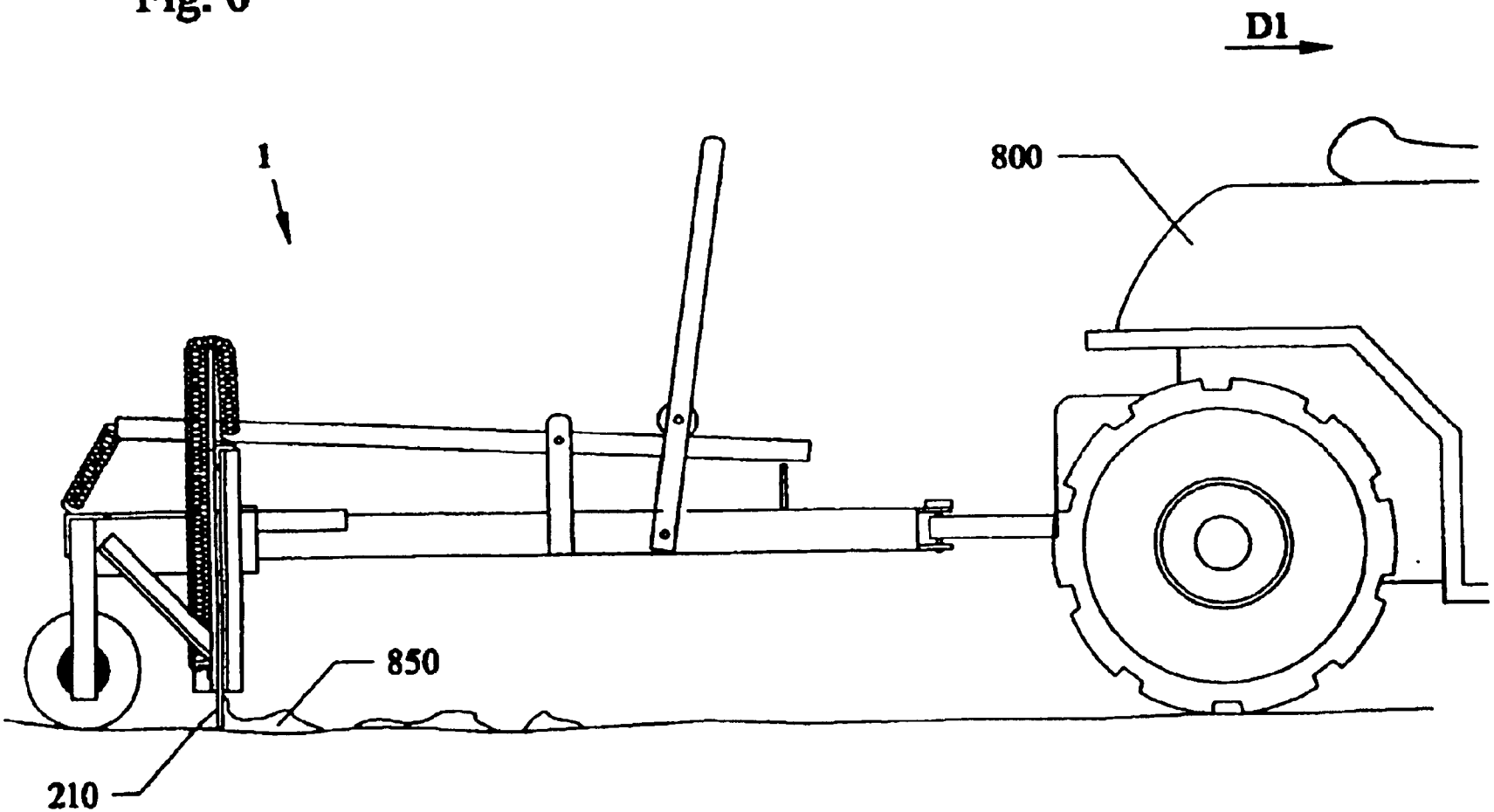
FIG. 6 shows the first embodiment of the preceding figures attached to a towing vehicle.

FIG. 6 shows the preferred embodiment 1 of the preceding figures attached to a towing vehicle 800 such as a small tractor and all terrain vehicle(ATV where the vehicle 800 moving in the direction of arrow D1 scrapes earth/soil 850 with the downwardly positioned scraping/leveling plate 210.

Second Embodiment

Figures 7, 7A:
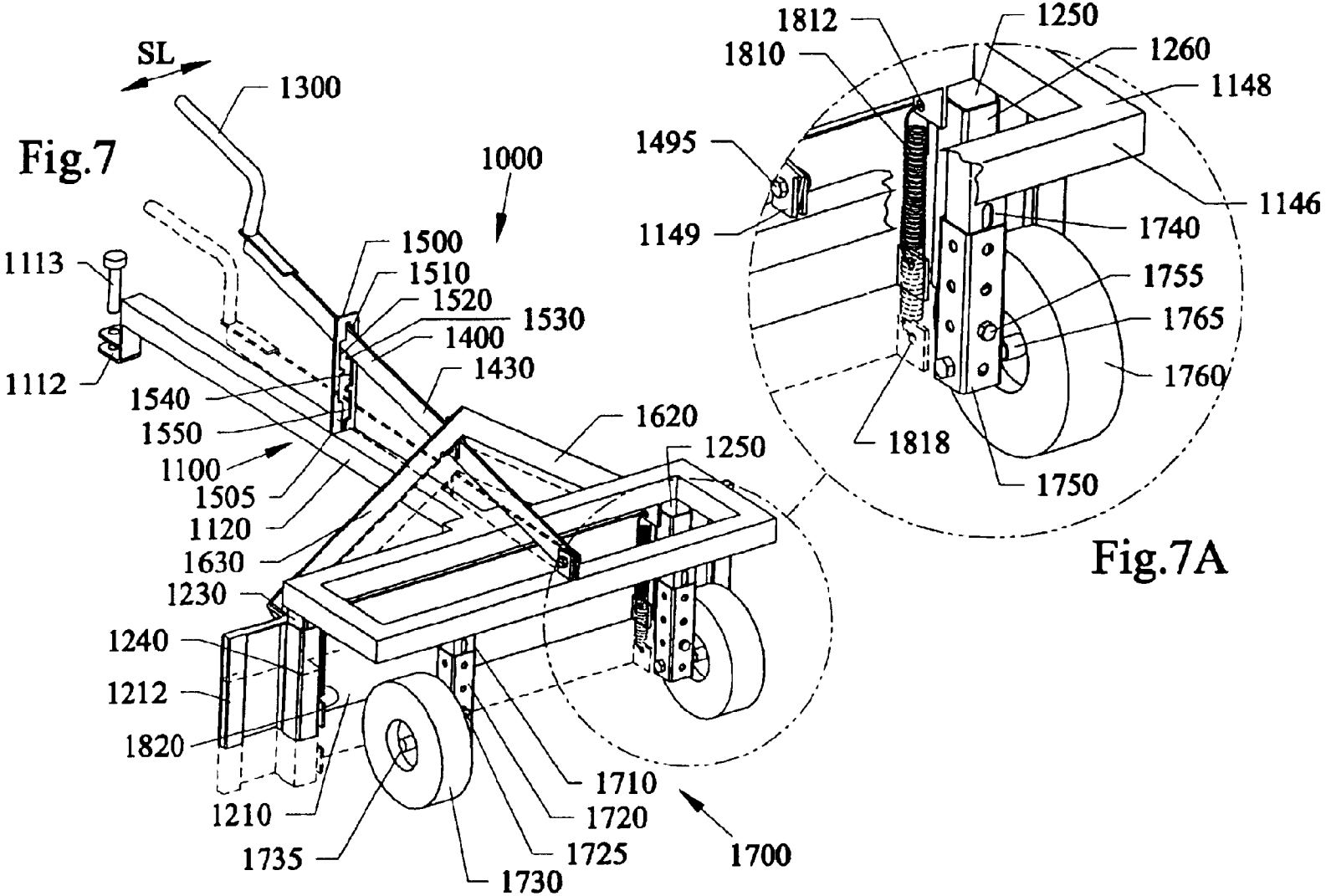
FIG. 7 is a perspective front view of a second preferred embodiment of the invention.
FIG. 7A is an enlarged view of the extension supports for one of the wheels of FIG. 7.
Figure 8:
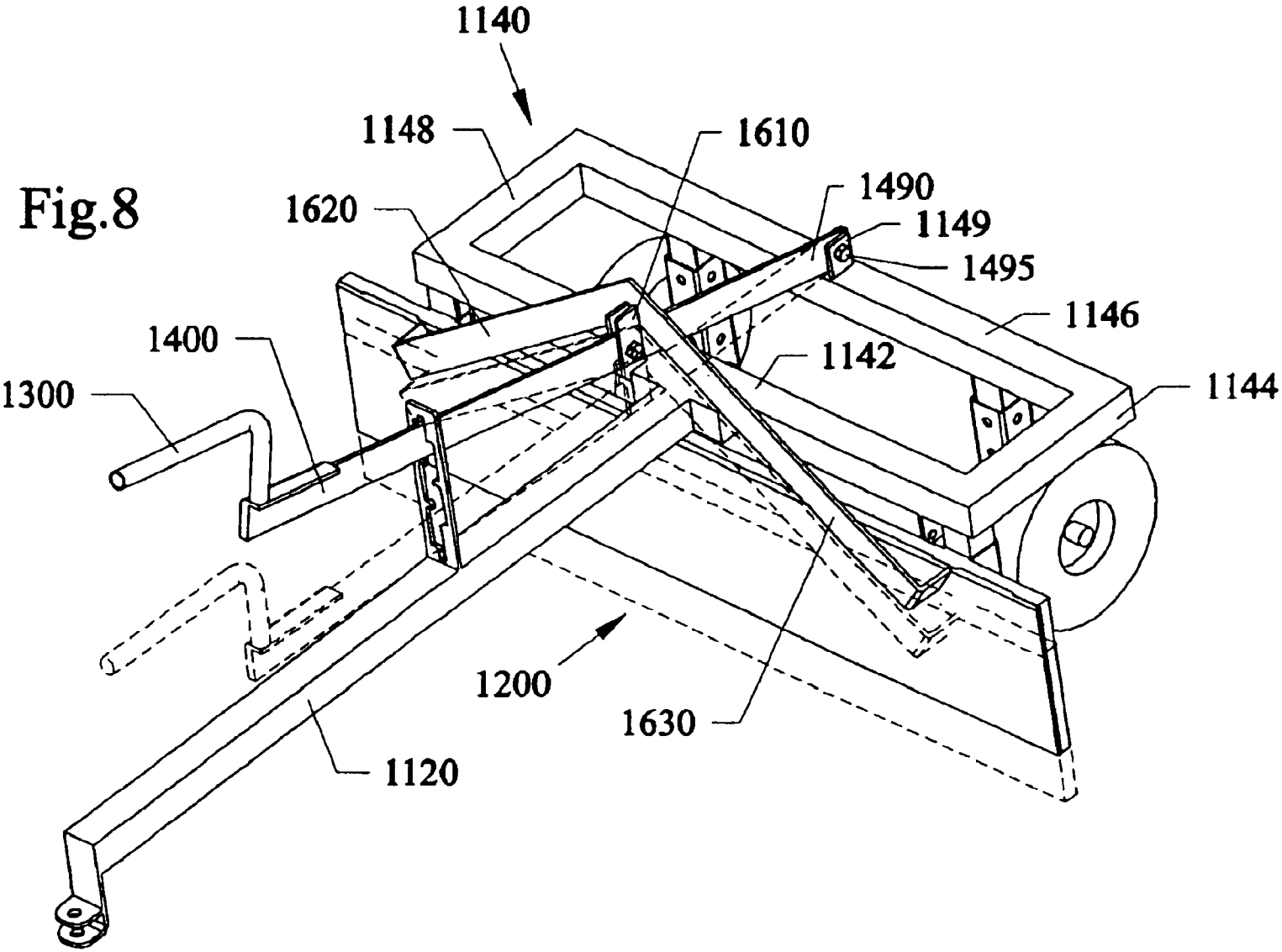
FIG. 8 is a perspective rear view of the embodiment of FIG. 7.
Figure 10:
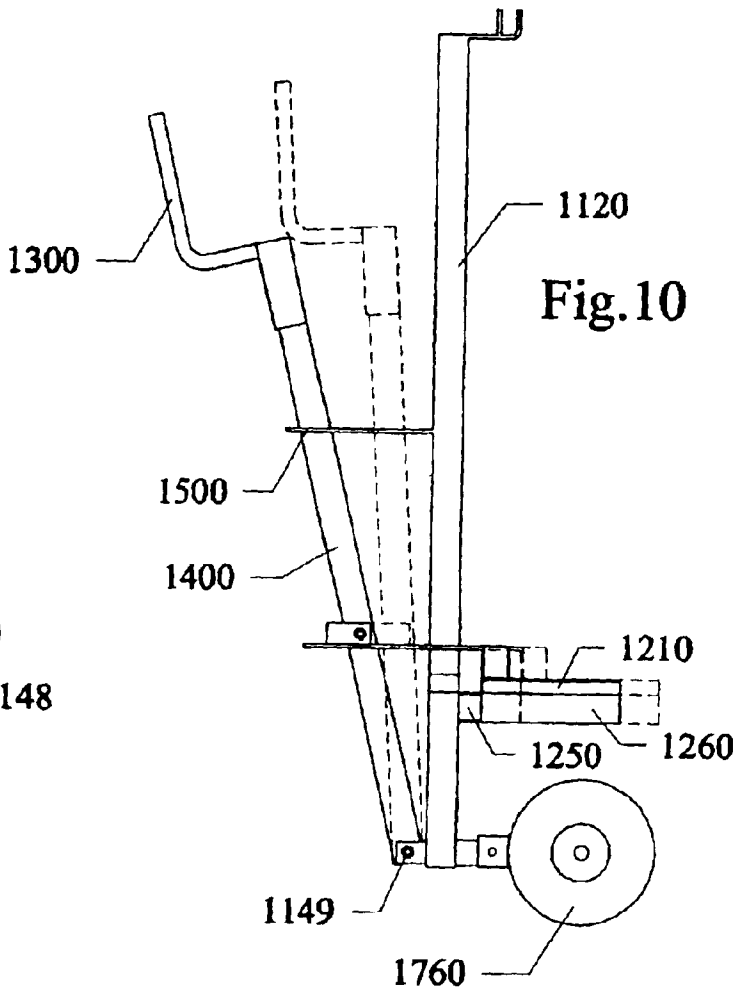
FIG. 10 is a side view of the second embodiment of FIG. 9 along arrow R1.
Figure 9:
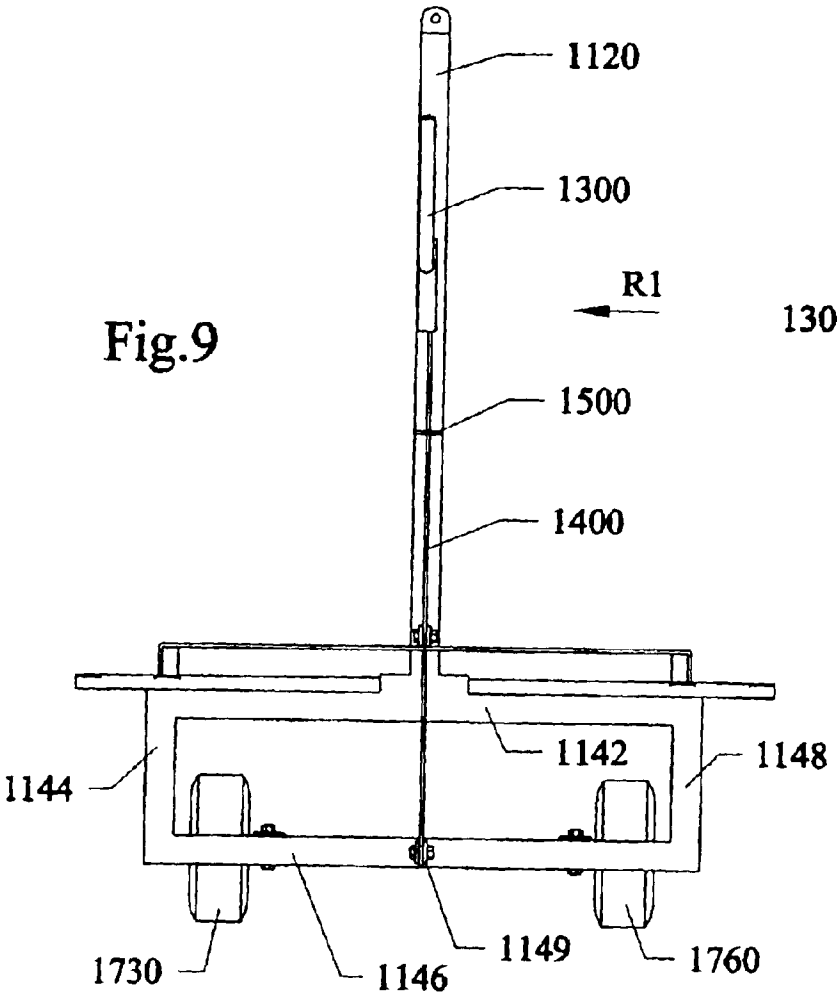
FIG. 9 is a top view of the second embodiment of FIGS. 7–8.

FIG. 7 is a perspective front view of a second preferred embodiment 1000 of the invention. FIG. 7A is an enlarged view of the extension supports 1740, 1750 for one of the wheels 1760 of FIG. 7. FIG. 8 is a perspective rear view of the embodiment 1000 of FIG. 7. FIG. 9 is a top view of the second embodiment 1000 of FIGS. 7–8. FIG. 10 is a right side view of the second embodiment 1000 of FIG. 9 along arrow R1.

Referring to FIGS. 7–10, second embodiment 1000 includes main frame 1100 that consists of a longitudinal member 1120 having a hitch member 1112 with connection pin 1113 that connects therethrough at one end, and a rectangular frame 1140 at an opposite end. The rectangular frame 1140 can include a rear member 1142, connected to side members 1144, 1148 which in turn are connected to an outer member 1146.

A double wheel assembly 1700 can be attached to the rectangular frame 1140. An upper left leg 1710 can be fixably attached to and protrude downward from a left portion of outer member 1146, with a lower left telescopic leg 1720 telescopingly attached about the upper left leg 1710. A pin 1725 such as a bolt can lock the lower leg 1720 to the upper leg 1710 at a selected height through various located through-holes. A left wheel 1730 can be attached by an axle member 1735 to lower left leg 1720. An upper right leg 1740 can be fixably attached to and protrude downward from a right portion of outer member 1146, with a lower right telescopic leg 1750 telescopingly attached about the upper right leg 1740. A pin 1755 such as a bolt can lock the lower leg 1750 to the upper leg 1740 at a selected height through various located through-holes. A right wheel 1760 can be attached by an axle member 1765 to lower right leg 1750.

Referring to FIGS. 7–10, a ground leveler assembly 1200 can be raised and lowered by the arm 1400 having one end 1490 pivotally attached to connection parallel plates 1149 protruding upwardly from a mid portion of outer member 1146 of rectangular frame 1140. A pin member 1495 through plates 1149 and end 1490 of arm 1400 allows the arm 1400 to pivot relative to rectangular frame member 1140. At the opposite end of arm 1400 can be a L-shaped handle member 1300 that can be gripped by a user for raising and lowering the arm 1400. Along a front portion 1430 of arm 1400 can be two parallel lift plates 1610 welded to a rear apex portion 1660 between left triangle leg 1630 and right triangle leg 1620. A pin 1650 connects the two parallel lift plates 1610 that sandwhich a front portion 1430 of arm 1400 therebetween so that raising and lowering arm 1400 allows triangle lift 1600 to move upward and downward as well.

The triangle lift assembly 1600 is attached to ground leveler assembly 1200. Fixably attached to and extending downwardly from left triangle leg 1620 is a left plate leg 1230, with a left telescopic leg 1240 telescopingly attached there-about. A pin 1245 such as a bolt attaches the left telescopic leg at different heights through various through-holes. Fixably attached to and extending downwardly from a right triangle leg 1620 is a right plate leg 1250, with a right telescopic leg 1260 telescopingly attached there-about. Another pin(similar to pin 1245, but not shown) such as a bolt attaches the right telescopic leg at different heights through various through-holes. A planar rectangular leveling plate 1210 can be fixably attached to both the left telescopic leg 1240 and right telescopic leg 1260. Thickened side edges 1212 on the leveling plate 1210 aids in strengthening the plate 1210.

The lifting arm 1400 can be locked in position by a latch assembly 1500 that can include a rectangular member 1505 fixably attached to and extending upward from a mid portion of longitudinal member 1120, and can include various internal slots 1510, 1520, 1530, 1540 and 1550 that alternate to each side edge of member 1505 where the user can slide the arm in the direction of double arrows SL. The user can raise or lower arm 1400 by handle 1300 and slide the arm to either side in the direction of arrows SL to catch and lock the arm 1400 to a selected position which in effect locks the leveling plate 1210 to a selected height as needed.

Biasing members 1810, 1820 such as springs can each be attached to the upper legs 1230 and 1250, and also to the telescopingly moving lower legs 1240, 1260 so that the leveling plate 1210 can be generally biased to be in a raised position. The legs 1230, 1250, 1240, 1260 further aid in strengthening the leveling the plate 1210 can keeping it perpendicular to the ground surface.

FIG. 11A is a side view of the second embodiment 1000 with the dragging/leveling plate 1210 in a raised position. Referring to FIGS. 7 and 11A, the user can slide the arm 1400 to one side SL and move handle 1300 downward in the direction of arrow LO to lower the leveling plate 1210 and slide the arm 1400 into another slot position in latch 1500.

FIG. 11B is a side view of the second embodiment 1000 with the dragging/leveling plate 1210 in a ground engaging lowered position. Referring to FIGS. 7 and 11B, when finished with a leveling operation, the user can slide the arm 1400 to one side SL and move handle 1300 upward in the direction of arrow RA to raise the leveling plate 1210 and then slide the arm 1400 into another slot position in latch 1500.

Figure 12:
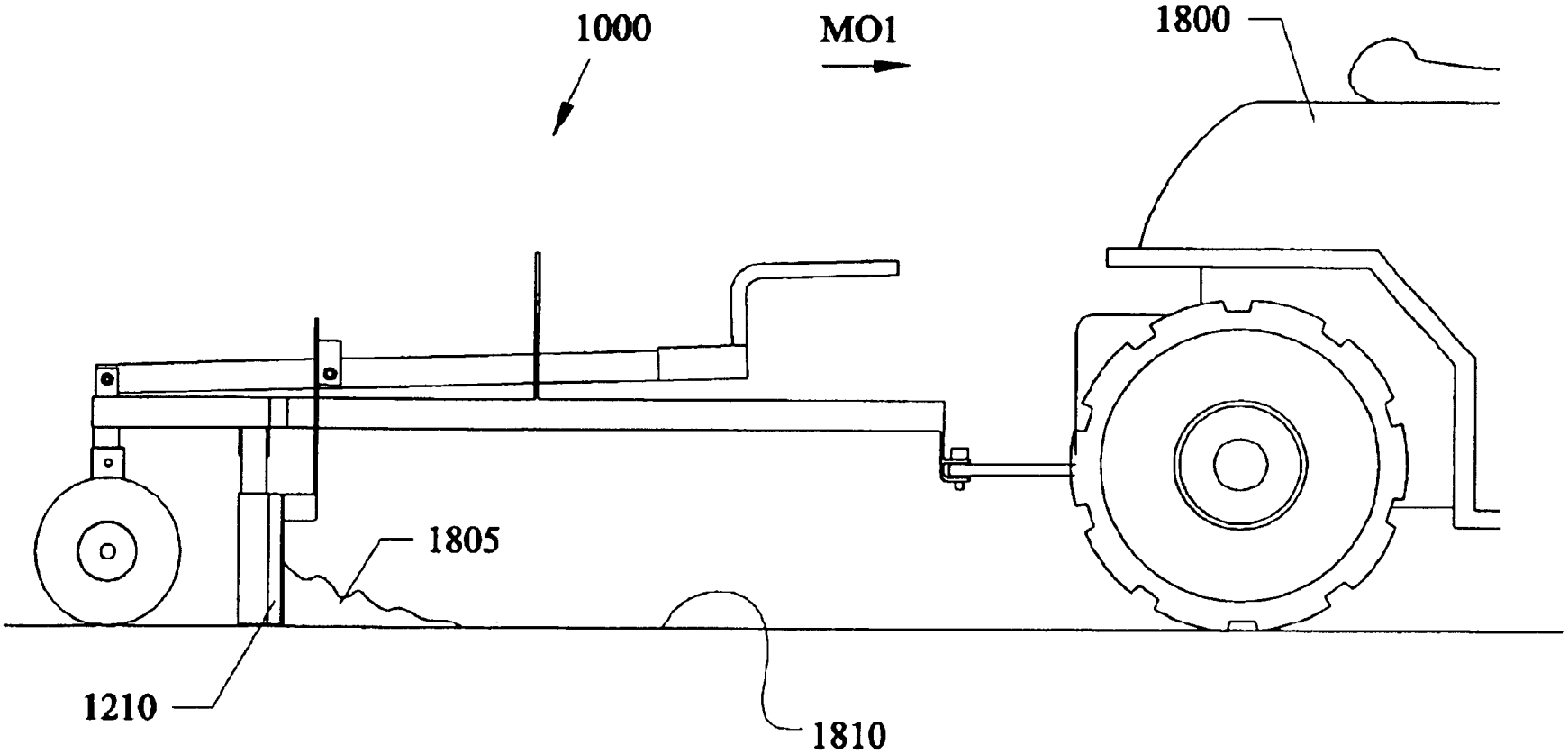
FIG. 12 shows a left side view of the second embodiment of the preceding figures attached to a towing vehicle.

FIG. 12 shows the second embodiment 1000 of the preceding figures attached to a towing vehicle 1800 moving in the direction of arrow MO1 where debris 1805, such as dirt, and the like is leveled over the ground surface 1810.

Third Embodiment

Figure 13:
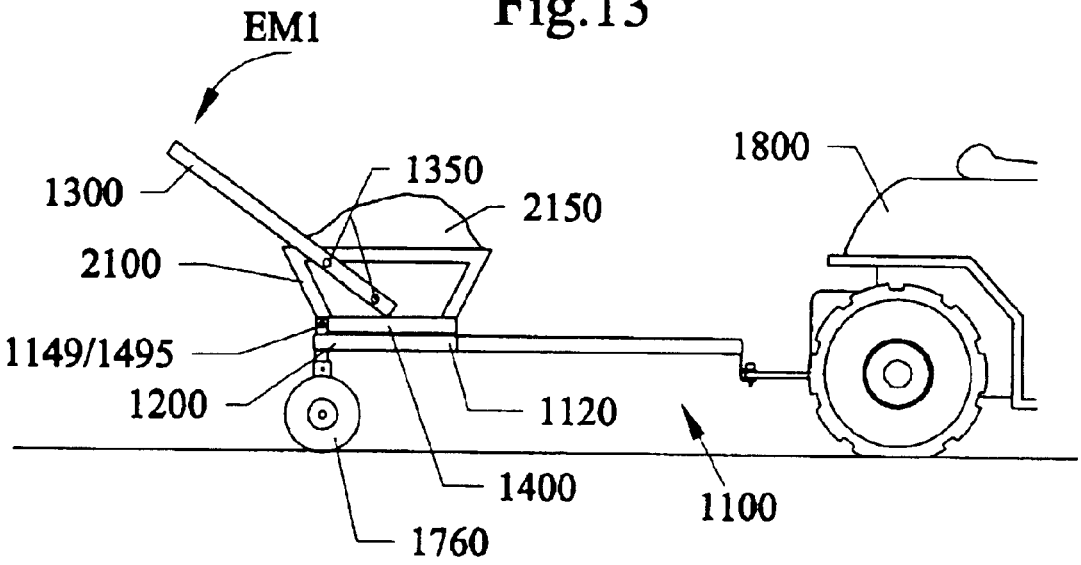
FIG. 13 shows a third embodiment using the main frame of the second embodiment supporting a filled barrel member.

FIG. 13 shows a third embodiment 2000 using the main frame 1100 and rectangular frame 1200 of the second embodiment 1000 supporting a filled barrel member 2100. The barrel member 2100 can be an open top compartment such as that found on a wheel barrel and the like, the bottom of which is fixably attached to arm member 1400(described in the previous embodiment 1000). Arm/base 1400 can include a longitudinal handle member 1300 at one end, and pivot components 1149, 1495 at the opposite end attached to rectangular frame 1200.

Figure 14:
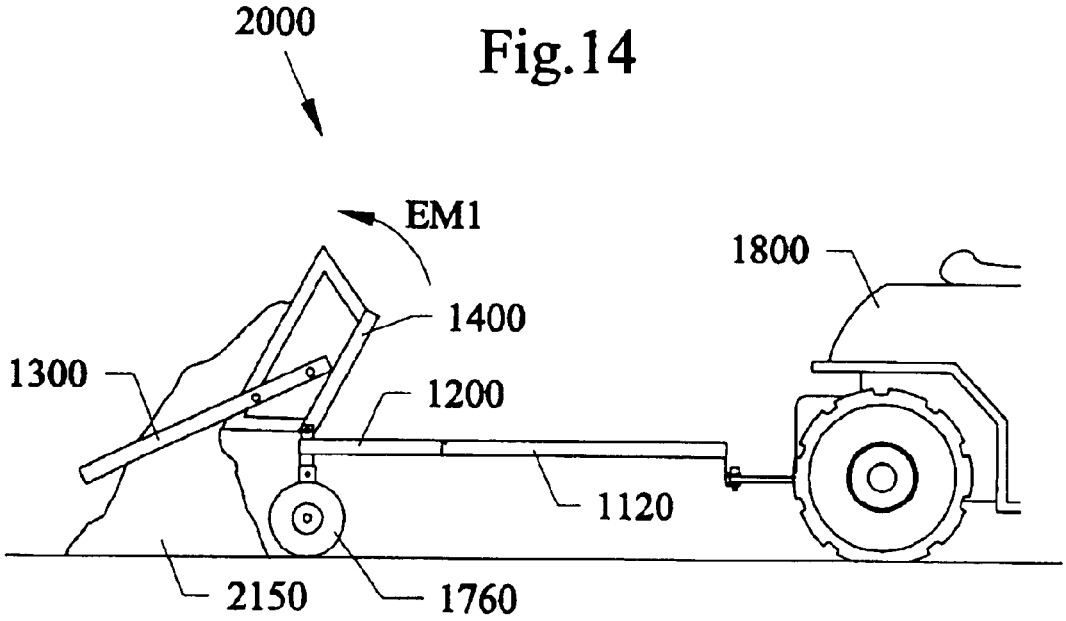
FIG. 14 shows the third embodiment of FIG. 13, with the barrel being emptied.

The longitudinal handle 1300 can be attached at an angle facing backward from the barrel compartment 2100 and fastened to the barrel compartment by fasteners, such as bolts, and the like. A preferred angle of the rear facing handle can allow for enhanced leverage for emptying the contents of the barrel compartment 2100. The barrel compartment 2100 can be filled, and then when needed, the handle 1300 can act as a lever and be pushed down in the direction of arrow EMI causing the barrel to pivot about components 1149/1495 to allow the internal contents 2150 such as debris and the like, to be emptied out. FIG. 14 shows the third embodiment 2000 of FIG. 13, with the barrel 2100 being emptied. Barrel compartment 2100 can be a wire cage basket, or be an open topped compartment with closed sides and bottom. Barrel compartment 2100 and/or handle 1300 can be formed from metal such as steel, aluminum, and the like, plastic, and combinations, thereof.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A mobile device for leveling and scraping ground surfaces, comprising in combination:

a frame being moveable over a ground surface;

a longitudinal arm having an end pivotally attached to the frame, and a handle end;

a plate attached to a midportion of the arm between the pivotally attached end and the handle end, wherein raising the handle end moves the plate between a lowered position adjacent the ground surface, to a raised position above the ground surface;

means for locking the arm to the raised and the lowered positions; and a spring for biasing the plate in the raised position, so that the plate tends to stay in the raised position.

2. The mobile device of claim 1, wherein the locking means includes:

latch means for the arm into plural height positions.

3. The mobile device of claim 2, wherein the latch means includes:

catch slots located at different heights for allowing the arm to slidingly lock into.

4. The mobile device of claim 1, further comprising:

wheel means attached to the frame.

5. The mobile device of claim 4, further comprising:

a first member telescopingly received within a second member; and means for locking the first member to different positions relative to the second member so that the wheel means can be locked at different heights to the frame.

6. The mobile device of claim 1, further comprising:

a hitch portion for attaching the frame to a mobile vehicle.

7. The mobile device of claim 6, wherein the mobile vehicle is selected from at least one of: a small tractor and a all terrain vehicle (ATV).

8. A mobile device for leveling and scraping ground surfaces, comprising in combination:

a frame being moveable over a ground surface;

a longitudinal arm having an end pivotally attached to the frame, and a handle end;

a plate attached to a midportion of the arm between the pivotally attached end and the handle end, wherein raising the handle end moves the plate between a lowered position adjacent the ground surface, to a raised position above the ground surface;

means for locking the arm to the raised and the lowered positions;

wheel means attached to the frame;

a first member telescopingly received within a second member; and means for locking the first member to different positions relative to the second member so that the wheel means can be locked at different heights to the frame.

9. The mobile device of claim 8, further comprising:

a spring for biasing the plate in the raised position, so that the plate tends to stay in the raised position.

10. The mobile device of claim 8, wherein the locking means includes:

latch means for the arm into plural height positions.

11. The mobile device of claim 10, wherein the latch means includes:

catch slots located at different heights for allowing the arm to slidingly lock into.

12. The mobile device of claim 8, further comprising:

wheel means attached to the frame.

13. The mobile device of claim 8, further comprising:

a hitch portion for attaching the frame to a mobile vehicle.

14. The mobile device of claim 13, wherein the mobile vehicle is selected from at least one of: a small tractor and a all terrain vehicle (ATV).

* * * * *